US007233136B2

(12) United States Patent
Makino et al.

(10) Patent No.: US 7,233,136 B2
(45) Date of Patent: Jun. 19, 2007

(54) CIRCUIT FOR OUTPUTTING STABLE REFERENCE VOLTAGE AGAINST VARIATION OF BACKGROUND TEMPERATURE OR VARIATION OF VOLTAGE OF POWER SOURCE

(75) Inventors: Yasuaki Makino, Okazaki (JP); Norikazu Ohta, Aichi-gun (JP); Yoshie Ohira, Nagoya (JP); Hirofumi Funabashi, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/311,182

(22) Filed: Dec. 20, 2005

(65) Prior Publication Data

US 2006/0176043 A1 Aug. 10, 2006

(30) Foreign Application Priority Data

Feb. 8, 2005 (JP) ..... 2005-031625

(51) Int. Cl.
*G05F 3/16* (2006.01)
*G05F 3/20* (2006.01)

(52) U.S. Cl. ..... 323/313; 323/316; 327/540

(58) Field of Classification Search ..... 323/313, 323/316, 317; 327/539, 540, 541
See application file for complete search history.

(56) References Cited

U.S. PATENT DOCUMENTS 5,610,506 A * 3/1997 McIntyre ..... 323/313
5,629,611 A * 5/1997 McIntyre ..... 323/313
5,751,142 A * 5/1998 Dosho et al. ..... 323/316
5,821,807 A * 10/1998 Brooks ..... 327/540
5,861,771 A * 1/1999 Matsuda et al. ..... 327/540
5,867,013 A * 2/1999 Yu ..... 323/314
5,955,873 A * 9/1999 Maccarrone et al. ..... 323/314
6,018,235 A * 1/2000 Mikuni ..... 323/313
6,075,407 A * 6/2000 Doyle ..... 327/539
6,124,704 A * 9/2000 Annema ..... 323/313
6,147,908 A * 11/2000 Abugharbieh et al. ... 365/185.2
6,204,653 B1 * 3/2001 Wouters et al. ..... 323/313
6,411,158 B1 * 6/2002 Essig ..... 327/539
6,441,674 B1 * 8/2002 Lin ..... 327/512
6,509,726 B1 * 1/2003 Roh ..... 323/313
6,765,431 B1 * 7/2004 Coady ..... 327/539
6,794,856 B2 * 9/2004 Fernald ..... 323/313
6,844,711 B1 * 1/2005 Sutardja et al. ..... 323/314
6,992,472 B2 * 1/2006 Schimper ..... 323/313
7,005,839 B2 * 2/2006 Wada ..... 323/316
7,019,584 B2 * 3/2006 Bartel et al. ..... 327/539
7,023,194 B1 * 4/2006 Sutardja et al. ..... 323/314

FOREIGN PATENT DOCUMENTS

JP A-2003-007837 1/2003

* cited by examiner

*Primary Examiner*—Bao Q. Vu
(74) *Attorney, Agent, or Firm*—Posz Law Group, PLC

(57) ABSTRACT

A reference voltage circuit includes an operational amplifier, a first fixed resistance resistor, a second fixed resistance resistor, a third fixed resistance resistor, a first diode and a second diode. The reference voltage circuit further includes a fourth fixed resistance resistor having an end connected to a non-inverting input terminal of the operational amplifier and the other end connected to the first diode. The reference voltage circuit is characterized by a value of the resistance of the fourth resistor being less than the resistance of the first resistor and a temperature coefficient of the fourth resistor being greater than any of the temperature coefficients of the first, second and third resistors.

6 Claims, 4 Drawing Sheets

CIRCUIT FOR OUTPUTTING STABLE REFERENCE VOLTAGE AGAINST VARIATION OF BACKGROUND TEMPERATURE OR VARIATION OF VOLTAGE OF POWER SOURCE

CROSS REFERENCE TO RELATED APPLICATION

This application is based upon, claims the benefit of priority of, and incorporates by reference the contents of Japanese Patent Application No. 2005-31625 filed on Feb. 8, 2005.

TECHNICAL FIELD

The technical field relates generally to a reference voltage circuit for supplying a stable voltage against variation of background temperature or variation of the voltage of a DC power source (for example, battery), and, more particularly, to a circuit for outputting a stable reference voltage by utilizing a band gap voltage of a semiconductor (typically, silicon or the like) including a pn junction.

BACKGROUND

FIG. 6 shows a conventional reference voltage circuit 100. The reference voltage circuit 100 is a circuit for converting a DC power supply voltage $V_{DD}$ to a stable reference voltage $V_{REF}$, and particularly it is designed so as to supply a reference voltage $V_{REF}$ which is adjusted to a fixed value against variation of background temperature. The conventional reference voltage circuit 100 is equipped with an operational amplifier OP, a first resistor $R_1$, a second resistor $R_2$, a third resistor $R_3$, a first diode D1 and a second diode D2.

The second diode D2 is a diode group containing plural diodes connected to one another in parallel, and each diode has the same specification as the first diode D1.

Positive and negative power supply lines 36 and 37 are connected to the positive and negative terminals of a DC power source, and the positive and negative power supply lines 36 and 37 are connected to the positive and negative power supply terminals of the operational amplifier OP. One end of the first resistor $R_1$ is connected to the output terminal of the operational amplifier OP, and the other end is connected to the non-inverting input terminal of the operational amplifier OP. One end of the second resistor $R_2$ is connected to the output terminal of the operational amplifier OP, and the other end thereof is connected to the inverting input terminal of the operational amplifier OP. One end of the third resistor $R_3$ is connected to the inverting input terminal of the operational amplifier OP, and the other end thereof is connected to the anode terminal of the second diode D2. The cathode terminal of the second diode D2 is connected to the negative power supply line 37.

The second diode D2 is inserted in the forward direction with respect to the negative power supply line 37. The anode terminal of the first diode D1 is connected to the non-inverting input terminal of the operational amplifier OP, and the cathode terminal thereof is connected to the negative power supply line 37. The first diode D1 is inserted in the forward direction with respect to the negative power supply line 37. JP-A-2003-7837 discloses an example of this type of reference voltage circuit.

When the forward voltage drop $V_{D1}[T]$ of the first diode D1 is represented by an equation, the following equation (1) is achieved.

$$V_{D1}[T] = V_{BG} - (V_{BG} - V_{D1}[T_0])\frac{T}{T_0} - (\eta - 1)\frac{kT}{q}\ln\frac{T}{T_0} \tag{1}$$

T represents the temperature achieved by representing the background temperature of the reference voltage circuit 100 as the absolute temperature. $T_0$ represents a reference absolute temperature, and it may be set to 20° C. (represented by Celsius), for example). $V_{BG}$ represents the band gap voltage of a pn junction contained in the first diode D1, and it is an inherent value in material. η represents a constant dependent on the manufacturing process of the reference voltage circuit 100, and it is normally equal to about 4. k represents the Boltzmann constant, and q represents the quantity of electric charge of one electron. The equation (1) is used in the other embodiments, and the symbols of the equation (1) has the same meaning as described above.

As well known, the reference voltage $V_{REF}[T, V_{DD}]$ output from the reference voltage circuit 100 varies while following the background temperature T and the DC power supply voltage $V_{DD}$. The variation of the reference voltage with respect to the background temperature can be represented by the following equation (2). Symbols achieved by adding numerals to symbols R representing the resistors represent the resistance values of the resistors added with the numbers.

$$V_{REF}[T] = V_{D1}[T] + \frac{R_2}{R_3}\frac{k}{q}\ln\left(\frac{nR_2}{R_1}\right)\times T \tag{2}$$

n represents the number of diodes constituting the second diode D2. Or, n also represents the ratio between the area constituting the pn junction of the first diode D1 and the area constituting the pn junction of the second diode D2.

In the conventional reference voltage circuit 100, when the equation (1) is substituted into the equation (2), the resistance values of the respective fixed resistors $R_1$, $R_2$, $R_3$ are adjusted so that the primary term of the absolute temperature T of the equation (1) and the primary term of the absolute temperature T of the equation (2) are offset with each other, whereby the effect of the variation of the background temperature T on the reference voltage $V_{REF}$ is suppressed.

However, as shown in the equation (1), higher order terms concerning the background temperature exist actually. Accordingly, when a more stable reference voltage $V_{REF}$ is needed, the effect of the higher order terms must be considered. The higher order terms concerned cannot be offset by merely adjusting the resistance values of the respective fixed resistors $R_1$, $R_2$, $R_3$.

Furthermore, it is known that the reference voltage $V_{REF}[T, V_{DD}]$ of the conventional reference voltage circuit 100 is apt to vary while following variation of the DC power source voltage $V_{DD}$. This phenomenon is caused by the fact that the offset voltage of the operational amplifier OP varies while following the variation of the DC power source voltage $V_{DD}$. For example, when a battery or the like is used as the DC power source, the above phenomenon appears because the DC power source voltage greatly varied with time lapse.

SUMMARY

It is an object to provide a circuit for compensating for the effect of variation of background temperature with high precision and outputting a highly stable reference voltage.

It is another object to provide a circuit for compensating for the effect of variation of a power source voltage with high precision and outputting a highly stable reference voltage.

It is another object to provide a circuit for compensating for both the effects of variation of background temperature and variation of a power source voltage at the same time and outputting a stable reference voltage.

In order to attain the above objects, a fourth resistor is added to the conventional reference voltage circuit. The reference voltage is stabilized by adding the fourth resistor. The effect of the variation of the background temperature or the effect of the variation of the power source voltage can be compensated with high precision by the characteristic of the fourth resistor. Both the modes have the common technical feature of adding the fourth resistor which is different from the conventional technique, and they are associated with each other to form a single general inventive concept.

That is, there is provided a reference voltage circuit for outputting a stable reference voltage. The reference voltage circuit is equipped with an operational amplifier, a first resistor, a second resistor, a third resistor, a fourth resistor, a first semiconductor including an pn junction and a second semiconductor including a pn junction, and these elements are connected to one another as follows.

Positive and negative power supply lines connected to the positive and negative terminals of the DC power source are connected to the positive and negative power supply terminals of the operational amplifier. One end of the first resistor is connected to the output terminal of the operational amplifier, and the other end thereof is connected to the non-inverting input terminal of the operational amplifier. One end of the second resistor is connected to the output terminal of the operational amplifier, and the other end thereof is connected to the inverting input terminal. One end of the third resistor is connected to the inverting input terminal of the operational amplifier, and the other end thereof is connected to the second semiconductor. One end of the fourth resistor is connected to the non-inverting input terminal, and the other end thereof is connected to the first semiconductor. The first semiconductor is inserted in the forwardly direction with respect to the negative power supply line, and the second semiconductor is inserted in the forward direction with respect to the negative power supply line. Furthermore, the resistance value of the fourth resistor is adjusted to be smaller than the resistance value of the first resistor.

A diode is a typical element of the semiconductor including the pn junction, however, the semiconductor is not limited to the diode. For example, there may be used a semiconductor having a pn junction constructed between the base and emitter of a bipolar transistor by short-circuiting the base and collector of the bipolar transistor.

The first resistor, the second resistor and the third resistor are typically fixed resistors, and the resistance values thereof are frequently invariable. Here, the fixed resistor means any resistor whose resistance value is substantially invariable when the reference voltage circuit is operated. The fixed resistor also contains any resistor whose resistance value is adjusted when the reference voltage circuit is not operated.

The resistance value of the fourth resistor is adjusted to be smaller than the resistance value of the first resistor. Therefore, even when the fourth resistor is added to the conventional reference voltage circuit, the effect of the characteristic of the fourth resistor on the coefficient of the primary term of the equation (2) can be reduced. Accordingly, as in the case of the conventional reference voltage circuit, the coefficient of the primary term of the equation (2) can be offset by adjusting the resistance values of the first, second and third resistors, and also the effect of the variation of the background temperature can be compensated with high precision or the effect of the variation of the power source voltage can be compensated with high precision by the characteristic of the fourth resistor.

Accordingly, there is provided a reference voltage circuit for outputting a stable reference voltage against variation of background temperature. In this case, it is preferable that a resistor having a resistance temperature coefficient adjusted to be larger than the resistance temperature coefficients of the first, second and third resistors is used as the fourth resistor. Accordingly, there can be achieved a reference voltage circuit for outputting a stable reference voltage against the environmental voltage.

A reference voltage circuit is equipped with a fourth resistor in addition to the first, second and third resistors. By adding the fourth resistor, the coefficients of the higher order terms of the equation (2) are made to reflect the characteristic of the fourth resistor. By adjusting the resistance temperature coefficient of the fourth resistor so that the resistance temperature coefficient of the fourth resistor is larger than the resistance temperature coefficients of the first, second and third resistors, the coefficients of the higher order terms of the equation (2) can be reduced more greatly as compared with the case where the fourth resistor does not exist. The effect of the variation of the background temperature can be compensated with high precision, and the stable reference voltage can be achieved.

Furthermore, as the resistance temperature coefficient of the fourth resistor is adjusted to be larger than the resistance temperature coefficients of the first, second and third resistors, the resistance value of the fourth resistor can be made smaller. As the fourth resistance is reduced, the effect of the characteristic of the fourth resistor on the primary term of the equation (2) can be more greatly reduced as described above.

According to another aspect, there is provided a reference voltage circuit for outputting a stable reference voltage against variation of a power source voltage. In this case, it is preferable that a variable resistor whose resistance value is variable while following variation of the power source voltage is used as the fourth resistor. Accordingly, there can be achieved a reference voltage circuit for outputting a stable reference voltage against variation of the power source voltage.

According to the reference voltage circuit, the phenomenon that the offset voltage of the operational amplifier varies while following the variation of the power source voltage can be compensated by utilizing the variable resistor whose resistance value varies while following the variation of the power source voltage. Here, the variable resistor includes both the resistors whose resistance values are increased and reduced while following the variation of the power source voltage. One of the variable resistor whose resistance value increases and the variable resistor whose resistance value decreases may be properly selected on the basis of the characteristic of the operational amplifier to be used. By using the variable resistor whose resistance value varies while following the variation of the power source voltage, a reference voltage circuit for outputting a stable reference voltage against the variation of the power source voltage can be achieved.

When the fourth resistor is a variable resistor, it is preferable that the resistance value of the fourth resistor varies while following increase of the power source voltage.

In general, the reference voltage output from the reference voltage circuit frequently exhibits a positive variation while following the variation of the power source voltage. That is, when the power source voltage increases, the reference voltage frequently increases. In order to suppress this phenomenon, it is preferable that the resistance value of the fourth resistor is reduced with respect to the increase of the power source voltage, whereby there can be achieved a reference voltage circuit for outputting a stable reference voltage against the variation of the power source voltage.

It is preferable that an n-type MOSFET is used as the fourth resistor. In the case of the n-type MOSFET, it is preferable that the drain terminal is connected to the non-inverting input terminal of the operational amplifier, the source terminal is connected to the first semiconductor and the gate terminal is connected to the positive power supply line.

In the case of the n-type MOSFET, when the power source voltage applied to the gate terminal is increased, the channel resistance is reduced. That is, when the power source voltage is increased, the resistance value between the drain terminal and source terminal of the n-type MOSFET is reduced. By using the n-type MOSFET as the fourth resistor, a phenomenon that the resistance value of the fourth resistor is reduced while following the increase of the power source voltage can be achieved. Accordingly, a reference voltage circuit for outputting a stable reference voltage against the variation of the power source voltage can be achieved.

A series circuit comprising a fixed resistor and a variable resistor may be used as the fourth resistor. In this case, the in-series circuit is designed to have such a characteristic that the resistance temperature coefficient of the fixed resistor is larger than the resistance temperature coefficients of the first, second and third resistors and the resistance value of the variable resistor varies while following the variation of the power source voltage.

The connection order of connecting the fixed resistor and the variable resistor in series is not limited to a specific one, and the fixed resistor may be located to be nearer to the negative power supply line or the variable resistor may be located to be nearer to the negative power supply line.

According to the reference voltage circuit described above, the reference voltage can be output with compensating for the effects of both the temperature variation and the power source voltage.

The reference voltage circuit uses at least four resistors. By adjusting the characteristics of the respective resistors, the effect of the temperature variation can be compensated with high precision and/or the effect of the power source voltage can be compensated with high precision, so that the stable reference voltage can be output.

BRIEF DESCRIPTION OF THE DRAWINGS

The above and other objects, features and advantages will become more apparent from the following detailed description made with reference to the accompanying drawings. In the drawings.

DETAILED DESCRIPTION OF THE PREFERRED EMBODIMENTS

Preferred embodiments will be described hereunder with reference to the accompanying drawings.

The following embodiments have the following main features.

First Embodiment

The resistance value of a fourth resistor is smaller than the resistance value of a first resistor.

Second Embodiment

The first, second and third resistors are fixed resistors.

Third Embodiment

The first, second and third resistors are formed of the same kind of material, and the temperature resistance coefficients thereof are equal to one another.

These embodiments will be described hereunder with reference to the accompanying drawings.

First Embodiment

Figure 1:
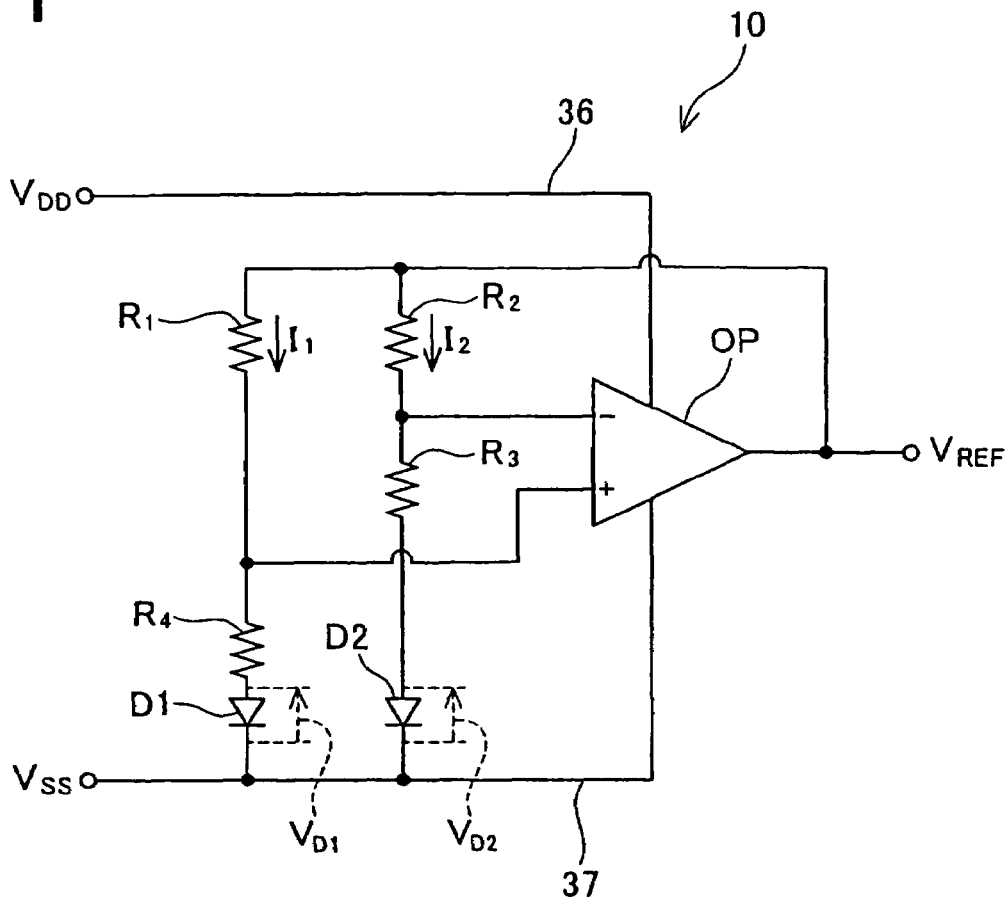
FIG. 1 shows a reference voltage circuit according to a first embodiment.

FIG. 1 shows a reference voltage circuit 10 for converting a DC power source voltage $V_{DD}$ supplied from a DC power source to a temperature-compensated reference voltage $V_{REF}$ and outputting the temperature-compensated reference voltage $V_{REF}$. The reference voltage circuit 10 is a circuit for converting the DC power source voltage $V_{DD}$ to the stable reference voltage $V_{REF}$, and it is particularly designed so that the reference voltage $V_{REF}$ which is adjusted to a fixed value is supplied against the variation of the background temperature.

The reference voltage circuit 10 is equipped with an operational amplifier OP, a first fixed resistor $R_1$, a second fixed resistor $R_2$, a third fixed resistor $R_3$, a fourth fixed resistor $R_4$, a first diode D1 and a second diode D2.

The second diode D2 is a diode group containing plural diodes connected to one another in parallel, and each diode has the same specification as the first diode D1.

Positive and negative power supply lines 36 and 37 are connected to the positive and negative terminals of the DC power source, and the positive and negative power supply lines 36 and 37 are connected to the positive and negative power supply terminals of the operational amplifier OP. One end of the first fixed resistor $R_1$ is connected to the output terminal of the operational amplifier OP, and the other end thereof is connected to the non-inverting input terminal of the operational amplifier Op. One end of the second fixed resistor $R_2$ is connected to the output terminal of the operational amplifier OP, and the other end thereof is connected to the inverting input terminal of the operational amplifier OP. One end of the third fixed resistor $R_3$ is connected to the inverting input terminal of the operational amplifier, and the other end thereof is connected to the anode terminal of the second diode D2. One end of the fourth resistor is connected to the non-inverting input terminal of the operational amplifier OP, and the other end thereof is connected to the anode terminal of the first diode D1. The cathode terminals of the first and second diodes D1 and D2 are connected to the negative power supply line 37. The negative power supply line 37 is grounded. The first diode D1 and the second diode D2 are inserted in the forward direction with respect to the negative power supply line 37.

Next, the phenomenon that the reference voltage $V_{REF}$ which is temperature-compensated with high precision is output by using the reference voltage circuit 10 will be described by using the following equations.

First, when substituting $T=T_0+\Delta T$ into the forward voltage drop $V_{D1}[T]$ of the diode D1 containing the temperature characteristic, the following equation (3) is achieved. The equation (1) described above may be used as the equation of the forward voltage drop $V_{D1}[T]$.

$$V_{D1}[T] = V_{D1}[T_0] - (V_{BG} - V_{D1}[T_0])\frac{\Delta T}{T_0} - (\eta - 1)\frac{kT_0}{q}\left(1 + \frac{\Delta T}{T_0}\right)\ln\left(1 + \frac{\Delta T}{T_0}\right) \tag{3}$$

In this equation (3), $(1+\Delta T/T_0)$ is subjected to Taylor's development, and approximated by using primary and secondary terms to achieve the following equation (4).

$$V_{D1}[T] = V_{D1}[T_0] - \left(V_{BG} - V_{D1}[T_0] + (\eta - 1)\frac{kT_0}{q}\right)\frac{\Delta T}{T_0} - (\eta - 1)\frac{kT_0}{2q}\left(\frac{\Delta T}{T_0}\right)^2 \tag{4}$$

Here, when the current flowing in the first diode D1 is represented by $I_1$ and the current flowing in the second diode D2 is represented by $I_2$, the following four equations can be achieved.

$$V_{D1} \cong (kT/q)\ln(I_1/Is) \tag{5}$$

$$V_{D2} \cong (kT/q)\ln(I_2/nIs) \tag{6}$$

$$I_1R_1 = I_2R_2 \tag{7}$$

$$V_{REF} = V_{D1} + I_1(R_1 + R_4) = V_{D2} + I_2(R_2 + R_3) \tag{8}$$

Is represents the saturated current of the diode D1.

Furthermore, when the resistance values of the respective fixed resistors $R_1$, $R_2$, $R_3$, $R_4$ are represented by functions $R_1[T]$, $R_2[T]$, $R_3[T]$ and $R_4[T]$ containing the temperature characteristics, the following equations can be achieved. The resistance values of the respective fixed resistors $R_1$, $R_2$, $R_3$, $R_4$ at the reference temperature $T_0$ are represented by $R_{10}$, $R_{20}$, $R_{30}$, $R_{40}$. The first fixed resistor $R_1$, the second fixed resistor $R_2$ and the third fixed resistor $R_3$ are formed of the same kind of material, and the temperature resistance coefficients thereof are equal to one another. On the other hand, the fourth fixed resistor $R_4$ is formed of a different kind of material, and the temperature resistance coefficient b thereof is different from those of the other fixed resistors $R_1$, $R_2$, $R_3$.

$$R_1[T] = R_{10}(1 + a\Delta)$$

$$R_2[T] = R_{20}(1 + a\Delta)$$

$$R_3[T] = R_{30}(1 + a\Delta)$$

$$R_4[T] = R_{40}(1 + b\Delta)$$

When the reference voltage $V_{REF}$ output from the reference voltage circuit 10 are represented by the functions containing the temperature characteristics with the above equations (5) to (8) and the resistance values $R_1[T]$, $R_2[T]$, $R_3[T]$, $R_4[T]$ of the respective resistors $R_1$, $R_2$, $R_3$, $R_4$ containing the temperature characteristics, the following equation (9) can be achieved.

$$\begin{aligned} V_{REF}[T] &= V_{D1}[T] + \frac{R_2[T]\left(1 + \frac{R_4[T]}{R_1[T]}\right)}{R_3[T]\left(1 - \frac{R_2[T]}{R_1[T]R_3[T]}R_4[T]\right)}\frac{kT}{q}\ln\left(\frac{nR_2[T]}{R_1[T]}\right) \\ &= V_{D1}[T] + \frac{R_{20}}{R_{30}}\frac{kT_0\left(1 + \frac{\Delta T}{T_0}\right)}{q}\frac{\left(1 + \frac{R_{40}}{R_{10}} \times \frac{1 + b\Delta T}{1 + a\Delta T}\right)}{\left(1 - \frac{R_{20}R_{40}}{R_{10}R_{30}} \times \frac{1 + b\Delta T}{1 + a\Delta T}\right)}\ln\left(\frac{nR_2}{R_1}\right) \end{aligned} \tag{9}$$

Here, $(1+a\Delta T)^{-1}$ in the equation (9) is subjected to Taylor's development. Furthermore, assuming that $a\Delta T$ and $b\Delta T$ are sufficiently smaller than 1, the equation (9) can be approximated to the following equation (10).

$$V_{REF}[T] \cong V_{D1}[T] + \frac{R_{20}}{R_{30}}\frac{kT_0\left(1 + \frac{\Delta T}{T_0}\right)}{q}\frac{\left(1 + \frac{R_{40}}{R_{10}}(1 + (b - a)\Delta T)\right)}{\left(1 - \frac{R_{20}R_{40}}{R_{10}R_{30}}(1 + (b - a)\Delta T)\right)}\ln\left(\frac{nR_2}{R_1}\right) \tag{10}$$

Furthermore, $(1-R_{20}\times R_{40}/R_{10}\times R_{30}(1+(b-a)\Delta T))^{-1}$ in the equation (10) is subjected to Taylor's development. Furthermore, assuming that $R_{40}/R_{10}$ and $R_{20}\times R_{40}/R_{10}\times R_{30}$ are sufficiently smaller than 1, the equation (10) can be approximated to the following equation (11).

$$\begin{aligned} V_{REF}[T] &\cong V_{D1}[T] + \frac{R_{20}}{R_{30}}\frac{kT_0\left(1 + \frac{\Delta T}{T_0}\right)}{q^0}\Big(1 + \\ &\quad \frac{R_{40}}{R_{10}}\left(1 + \frac{R_{20}}{R_{30}}\right)(1 + (b - a)\Delta T)\Big)\ln\left(\frac{nR_2}{R_1}\right) \\ &= V_{D1}[T] + \frac{R_{20}}{R_{30}}\frac{kT_0}{q}\left(1 + \frac{R_{40}}{R_{10}}\left(1 + \frac{R_{20}}{R_{30}}\right) + \right. \\ &\quad \left(1 + (1 + (b - a)T_0)\frac{R_{40}}{R_{10}}\left(1 + \frac{R_{20}}{R_{30}}\right)\right)\frac{\Delta T}{T_0} + \\ &\quad \left.(b - a)T_0\frac{R_{40}}{R_{10}}\left(1 + \frac{R_{20}}{R_{30}}\right)\left(\frac{\Delta T}{T_0}\right)^2\right)\ln\left(\frac{nR_2}{R_1}\right) \end{aligned} \tag{11}$$

By substituting the previously calculated equation (4) into the equation (11), the following equation (12) can be achieved.

$$\begin{aligned} V_{REF}[T] &= V_{D1}[T_0] + \frac{R_{20}}{R_{30}}\frac{kT_0}{q}\left(1 + \frac{R_{40}}{R_{10}}\left(1 + \frac{R_{20}}{R_{30}}\right)\right)\ln\left(\frac{nR_2}{R_1}\right) + \\ &\quad \left(\frac{R_{20}}{R_{30}}\frac{kT_0}{q}\left(1 + (1 + (b - a)T_0)\frac{R_{40}}{R_{10}}\left(1 + \frac{R_{20}}{R_{30}}\right)\right)\ln\left(\frac{nR_2}{R_1}\right) - \right. \\ &\quad \left.\left(V_{BG}V_{D1}[T_0] + (\eta - 1)\frac{kT_0}{q}\right)\right)\frac{\Delta T}{T_0} + \\ &\quad \left(\frac{R_{20}}{R_{30}}\frac{kT_0}{q}(b - a)T_0(b - a)T_0\frac{R_{40}}{R_{10}}\left(1 + \frac{R_{20}}{R_{30}}\right)\ln\left(\frac{nR_2}{R_1}\right) - \right. \\ &\quad \left.(\eta - 1)\frac{kT_0}{q}\right)\left(\frac{\Delta T}{T_0}\right)^2 \end{aligned} \tag{12}$$

As shown in the equation (12), it is found that by adding the fourth fixed resistor $R_4$, the resistance characteristic of the fourth fixed resistor $R_4$, that is, the resistance value $R_{40}$ at the reference temperature $T_0$ of the fourth fixed resistor $R_4$ and the difference (b−a) between the resistance temperature coefficient b of the fourth fixed resistor $R_4$ and the common resistance temperature coefficient a of the other fixed resistors $R_1$, $R_2$, $R_3$ reflects the secondary term of ΔT. As shown in the equation (12), when the difference (b−a) between the resistance temperature coefficients is adjusted to be a positive value, the coefficient of the secondary term of ΔT is reduced, and the effect of the higher order terms is reduced. Therefore, it is preferable that the resistance temperature coefficient b of the fourth fixed resistor $R_4$ is sufficiently larger than the resistance temperature coefficient a of the first fixed resistor $R_1$.

Furthermore, it is assumed that $R_{40}/R_{10}$ is sufficiently smaller than 1 when the equation (10) is approximated. Accordingly, when each condition is set on the basis of the equation (12), it is preferable that the fourth fixed resistor $R_4$ is sufficiently smaller than the first fixed resistor $R_1$. In this case, the condition of the equation (12) can be used.

Both the coefficients of the primary and secondary terms of ΔT of the equation (12) can be reduced or set to zero by adjusting the resistance values $R_{10}$, $R_{20}$, $R_{30}$, $R_{40}$ at the reference temperature $T_0$ of the respective fixed resistors $R_1$, $R_2$, $R_3$, $R_4$, the number n of the diodes constituting the second diode D2 and the difference (b−a) between the resistance temperature coefficient b of the fourth resistor $R_4$ and the common resistance temperature coefficient a of the other fixed resistors $R_1$, $R_2$, $R_3$. That is, the reference voltage circuit 10 can output a remarkably stable reference voltage $V_{REF}[T]$ that is not effected by temperature variation.

Figure 2:
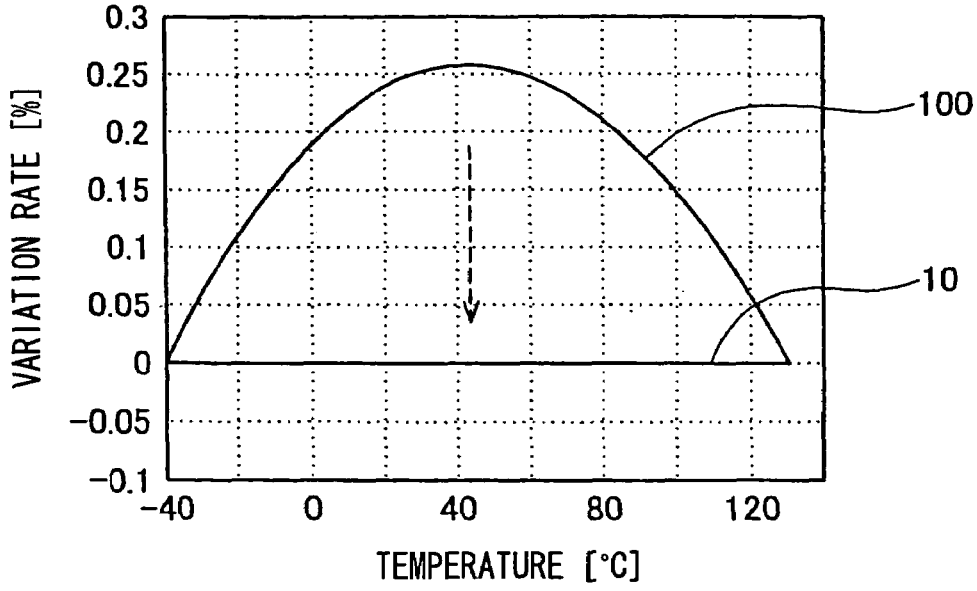
FIG. 2 is a diagram showing the variation rate of a reference voltage to the temperature variation.

FIG. 2 shows the temperature characteristic of the reference voltage $V_{REF}[T]$. Reference numeral 100 represents the temperature characteristic of the conventional reference voltage circuit shown in FIG. 6, and reference numeral 10 represents the temperature characteristic of the reference voltage circuit 10 of this embodiment shown in FIG. 1. FIG. 2 shows the variation rate of the reference voltage $V_{REF}[T]$ when the background temperature varies from −40 to about 120° C. The ordinate axis of FIG. 2 represents the variation rate of the reference voltage value $V_{REF}[T]$ at each temperature which is calculated with the reference voltage $V_{REF}[-40]$ at −40° C. set as a reference.

As shown in FIG. 2, the conventional reference voltage circuit 100 exhibits a convex-shaped variation while following the temperature variation. This is an effect of high order terms existing in the equation (1). On the other hand, in the case of the reference voltage circuit 10 of this embodiment, it is found that a remarkably stable reference voltage $V_{REF}$ [T] with respect to the temperature variation is output. The convex-shaped variation can be eliminated by reducing the higher order terms. The reference voltage circuit 10 of this embodiment can output the reference voltage $V_{REF}$ the temperature of which is accurately compensated.

In the first embodiment described above, it is preferable that the resistance characteristics of the fixed resistors $R_1$, $R_2$, $R_3$, $R_4$ are selected in the following order. First, the resistance characteristic of the fourth fixed resistor is determined. At this time, the fourth fixed resistor $R_4$ is selected under the condition that the resistance value of the fourth fixed resistor $R_4$ is smaller than that of the first fixed resistor $R_1$ and the resistance temperature coefficient thereof is larger than the resistance temperature coefficient of each of the other fixed resistors $R_1$, $R_2$, $R_3$. Next, the resistance values of the other fixed resistors $R_2$, $R_3$ are selected in conformity with the selected resistance characteristic of the fourth fixed resistor $R_4$ so that the coefficient of the primary term of ΔT of the equation (12) is equal to zero. Accordingly, there can be achieved the reference voltage circuit in which the effect of the higher order terms of ΔT of the equation (12) can be reduced, and further the effect of the primary term can be offset.

Second Embodiment

Figure 3:
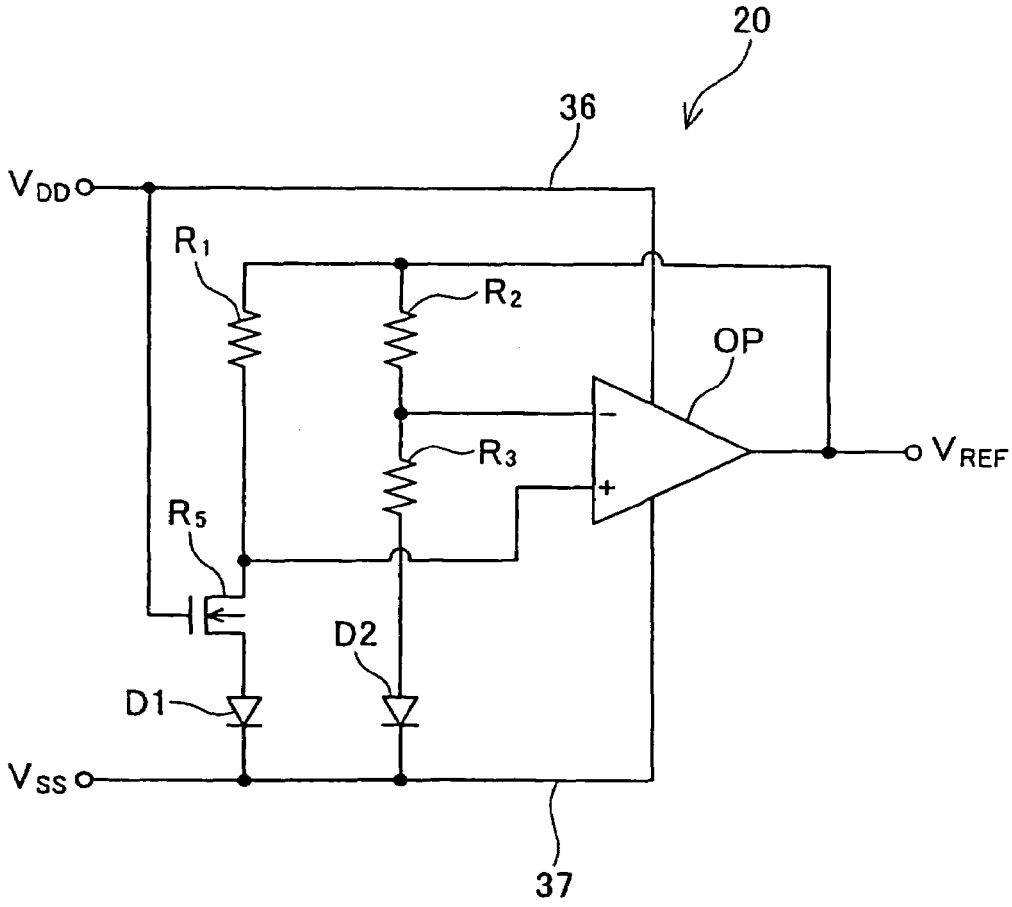
FIG. 3 shows a reference voltage circuit according to a second embodiment.

FIG. 3 shows a reference voltage circuit 20 for converting a DC power source voltage $V_{DD}$ supplied from a DC power source to a reference voltage $V_{REF}$ and then outputting the reference voltage $V_{REF}$. The reference voltage circuit 20 outputs the stable reference voltage $V_{REF}$ against variation of the DC power source voltage $V_{DD}$. In the reference voltage circuit 20, the fourth fixed resistor $R_4$ of the reference voltage circuit 10 of the first embodiment shown in FIG. 1 is changed to a transistor $R_5$. The other constituent elements are the same as the first embodiment. However, the resistance characteristics of the fixed resistors $R_1$, $R_2$, $R_3$ are adjusted as occasion demands. The transistor $R_5$ is an n-type MOSFET, and the drain terminal thereof is connected to the non-inverting input terminal of the operational amplifier OP. The source terminal of the n-type MOSFET is connected to the cathode terminal of the first diode D1, and the gate terminal thereof is connected to the positive power supply line 36. A transistor which is maintained on during the period when the DC power source voltage $V_{DD}$ is applied to the gate terminal, more specifically, within the variation range of the DC power source voltage $V_{DD}$ is selected as the resistor $R_5$. That is, the threshold value of the gate of the transistor $R_5$ is set to a voltage smaller than the variation range of the DC power source voltage $V_{DD}$.

Figure 6:
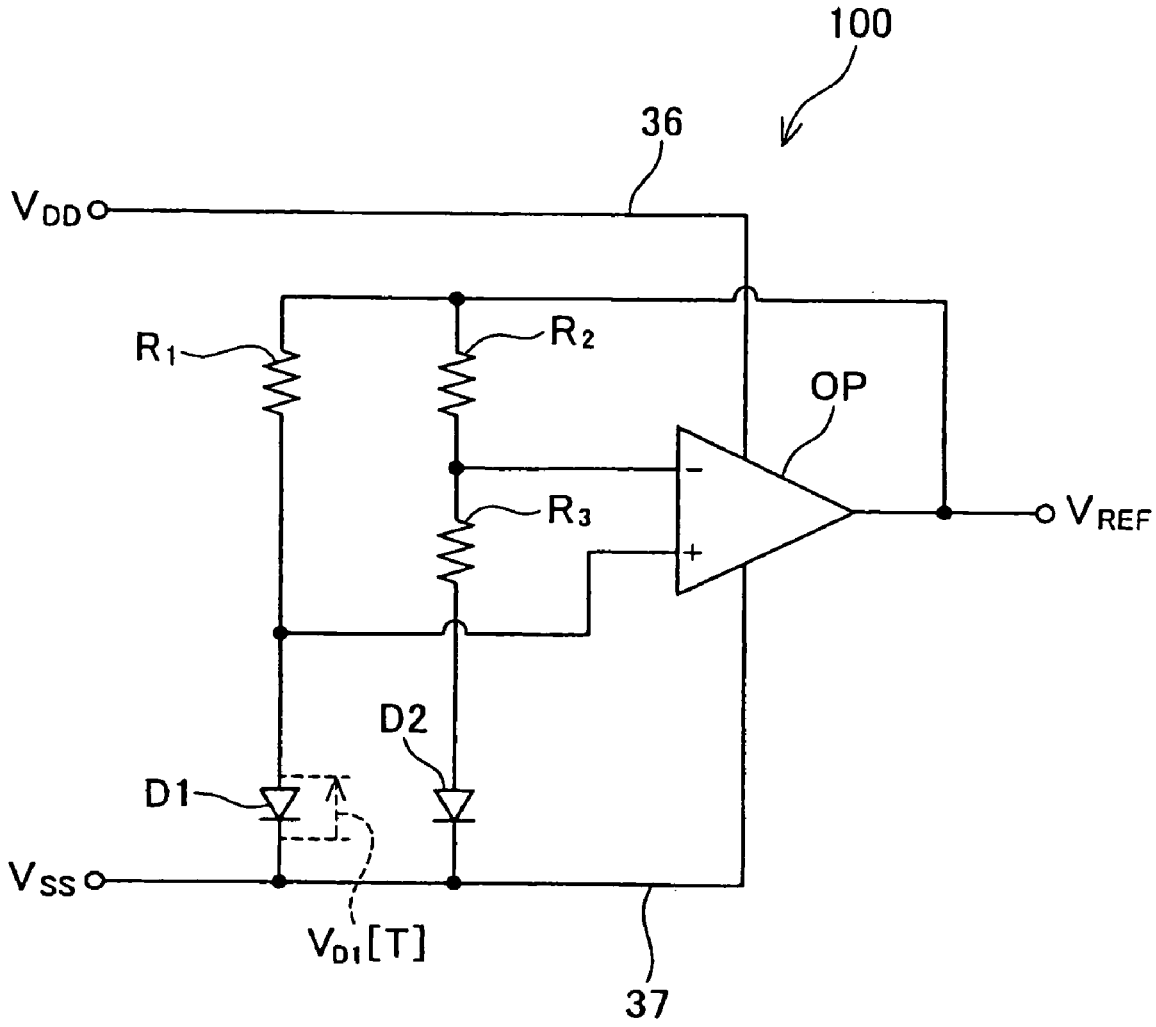
FIG. 6 PRIOR ART
FIG. 6 shows a conventional reference voltage circuit.

In the conventional reference voltage circuit 100 shown in FIG. 6, the offset voltage of the operational amplifier OP is generally varied while following the variation of the DC power source voltage $V_{DD}$. For example, when the offset voltage of the operational amplifier increases with respect to increase of the DC power source voltage $V_{DD}$, it is known that the reference voltage $V_{REF}$ increases if the DC power source voltage $V_{DD}$ increases. This phenomenon can be represented by the following equation (13).

$$V_{REF}[V_{DD}] \cong V_{REF}[V_{DD0}] + \frac{R_2}{R_3}(V_{OS}[V_{DD}] - V_{OS}[V_{DD0}]) \tag{13}$$

$V_{DD0}$ represents the DC power source voltage $V_{DD}$ as a reference, and it is normally set to 5V. $V_{OS}[V_{DD}]$ represents the offset voltage of the operational amplifier when the DC power source voltage $V_{DD}$ varies. $R_2$, $R_3$ in the equation represent the resistance values of the fixed resistors $R_2$, $R_3$. Here, the resistance values of the fixed resistors $R_2$, $R_3$ are assumed to be invariable with respect to the temperature. In other words, the resistance value at the reference temperature is used for the above equation. The resistance value of the first fixed resistor $R_1$ and the resistance of the transistor $R_5$ are also assumed to be invariable with respect to the temperature.

Next, the reference voltage circuit 20 of this embodiment will be described.

The DC power source voltage $V_{DD}$ is applied to the gate terminal of the transistor $R_5$. When the DC power source voltage $V_{DD}$ increases, the voltage applied to the gate terminal also increases. When the voltage applied to the gate terminal increases, the channel resistance is reduced. Accordingly, when the DC power source voltage $V_{DD}$ increases, the resistance value between the drain terminal and source terminal of the transistor $R_5$ is reduced. A phenomenon that the resistance value of the transistor $R_5$ is reduced while following the increase of the DC power source voltage $V_{DD}$ can be achieved by using the transistor $R_5$.

Here, the resistance value of the transistor $R_5$ is represented as a function to the DC power voltage $V_{DD}$. The resistance value of the transistor $R_5$ when the DC power source voltage $V_{DD}$ is equal to the reference value (normally 5V) is represented by $R_{50}$.

$$R_5[V_{DD}]=R_{50}(1+c\Delta V_{DD})$$

Here, c represents the power source voltage coefficient of the transistor $R_5$.

Furthermore, the offset voltage $V_{OS}[V_{DD}]$ of the operational amplifier OP is represented as a function to the DC power source voltage $V_{DD}$. The offset voltage $V_{OS}[V_{DD}]$ when the DC power source voltage $V_{DD}$ is equal to the reference value (normally, 5V) is represented by $V_{OS0}$. Here, d represents the power source voltage coefficient of the offset voltage $V_{OS}$ of the operational amplifier OP.

The equation (13) is ordered by using the equation of the resistance value $R_5[V_{DD}]$ of the transistor $R_5$ and the equation of the offset voltage $V_{OS}[V_{DD}]$ of the operational amplifier OP to achieve the following equation (14).

$$\begin{aligned} V_{REF}[V_{DD}] &= V_{D1} + \frac{R_2\left(1+\frac{R_5[V_{DD}]}{R_1}\right)}{R_3\left(1-\frac{R_2}{R_1R_3}R_5[V_{DD}\right)}\frac{kT}{q}\ln\left(\frac{nR_2}{R_1}\right) + \frac{R_2}{R_3}d\Delta V_{DD} \\ &= V_{D1} + \frac{kT}{q}\frac{R_2\left(1+\frac{R_{50}}{R_1}(1+c\Delta V_{DD})\right)}{R_3\left(1-\frac{R_2R_{50}}{R_1R_3}(1+c\Delta V_{DD})\right)}\ln\left(\frac{nR_2}{R_1}\right) + \frac{R_2}{R_3}d\Delta V_{DD} \end{aligned} \tag{14}$$

Here, $(1-R_2\times R_5/R_1\times R_3(1+c\Delta V_{DD}))^{-1}$ is subjected to Taylor's development, and further assuming that the $R_2\times R_{50}/R_1\times R_3$ and $c\Delta V_{DD}$ are sufficiently smaller than 1, the equation (14) can be approximated to the following equation (15).

$$\begin{aligned} V_{REF}[V_{DD}] &= V_{D1} + \frac{kT}{q}\frac{R_2\left(1+\frac{R_{50}}{R_1}\left(1+\frac{R_2}{R_3}\right)(1+c\Delta V_{DD})\right)}{R_3}\ln\left(\frac{nR_2}{R_1}\right) + \frac{R_2}{R_3}d\Delta V_{DD} \\ &= V_{D1} + \frac{kT}{q}\frac{R_2\left(1+\frac{R_{50}}{R_1}\left(1+\frac{R_2}{R_3}\right)\right)}{R_3}\ln\left(\frac{nR_2}{R_1}\right) + \left(\frac{kT}{q}\frac{R_2R_{50}\left(1+\frac{R_2}{R_3}\right)}{R_{1R_3}}c\ln\left(\frac{nR_2}{R_1}\right) + \frac{R_2}{R_3}d\right)\Delta V_{DD} \end{aligned} \tag{15}$$

As shown in the equation (15), the coefficient of the term of $\Delta V_{DD}$ of the equation (15) can be set to zero by adjusting the resistance value $R_{50}$ of the transistor $R_5$ in the case of the DC power source voltage $V_{DD}$ as the reference and the power source voltage coefficient c. That is, the reference voltage circuit 20 can output a remarkably stable reference voltage $V_{REF}[V_{DD}]$ which suffers no effect of the variation of the DC power source voltage $V_{DD}$.

Figure 4:
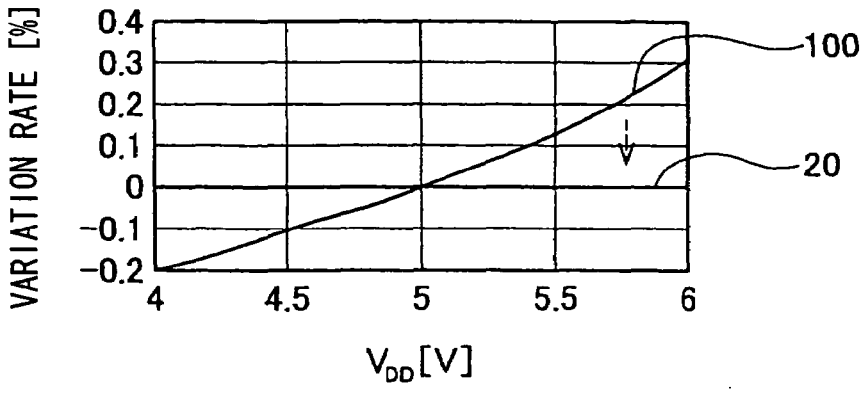
FIG. 4 shows the variation rate of a reference voltage to the variation of the power source voltage.

FIG. 4 shows the power source voltage characteristic of the reference voltage $V_{REF}[V_{DD}]$. Reference numeral 100 represents the power source voltage characteristic of the conventional reference voltage circuit 100 as shown in FIG. 6, and reference numeral 20 represents a power source voltage characteristic of the reference voltage circuit 20 of this embodiment shown in FIG. 3. The reference power source voltage is set to 5V, and the variation rate of the reference voltage $V_{REF}[V_{DD}]$ when the power source voltage varies from 4 to 6 V is shown in FIG. 4. The ordinate axis represents the calculated variation of the reference voltage value $V_{REF}[V_{DD}]$ at various voltages with the reference voltage $V_{REF}[5]$ at 5V set as a reference.

As shown in FIG. 4, the conventional reference voltage circuit 100 exhibits a positive variation while following the variation of the DC power source voltage. This is caused by an effect of increase of the offset voltage of the operational amplifier while following the increase of the DC power source voltage. On the other hand, in the case of the reference voltage circuit 20 of this embodiment, a reference voltage $V_{REF}[V_{DD}]$ which is remarkably stable with respect to the variation of the DC power source voltage is output. This is because the resistance value of the transistor $R_5$ is reduced in association with the increase of the DC power source voltage $V_{DD}$, whereby the increase of the offset voltage of the operational amplifier OP is compensated. The reference voltage circuit 20 of this embodiment can output the reference voltage $V_{REF}[V_{DD}]$ compensating for the variation of the DC power source voltage.

It is preferable that the second embodiment has the following features.

It is preferable that the resistance value $R_{50}$ of the transistor $R_5$ is sufficiently smaller than the resistance value $R_1$ of the first fixed resistor $R_1$. In the second embodiment, the variation of the background temperature is compensated by adjusting the respective fixed resistors $R_1$, $R_2$, $R_3$. However, by adding the transistor $R_5$, the temperature characteristic of the transistor $R_5$ affects the primary term of the equation (2) for adjusting the temperature compensation. However, by making the resistance value $R_{50}$ of the transistor $R_5$ sufficiently smaller than the resistance value $R_1$ of the first fixed resistor $R_1$, the temperature characteristic of the transistor $R_5$ can be substantially avoided from affecting the primary term of the equation (2). Accordingly, by making the resistance value $R_{50}$ of the transistor $R_5$ sufficiently smaller than the resistance value $R_1$ of the first fixed resistor $R_1$, the stable reference voltage can be achieved against the variation of the power source voltage while keeping the temperature compensation.

The embodiments of the present invention have been described above, however, these embodiments do not limit the present invention. Various modifications or changes may be made to the above embodiments without departing from the subject matter of the present invention.

Figure 5:
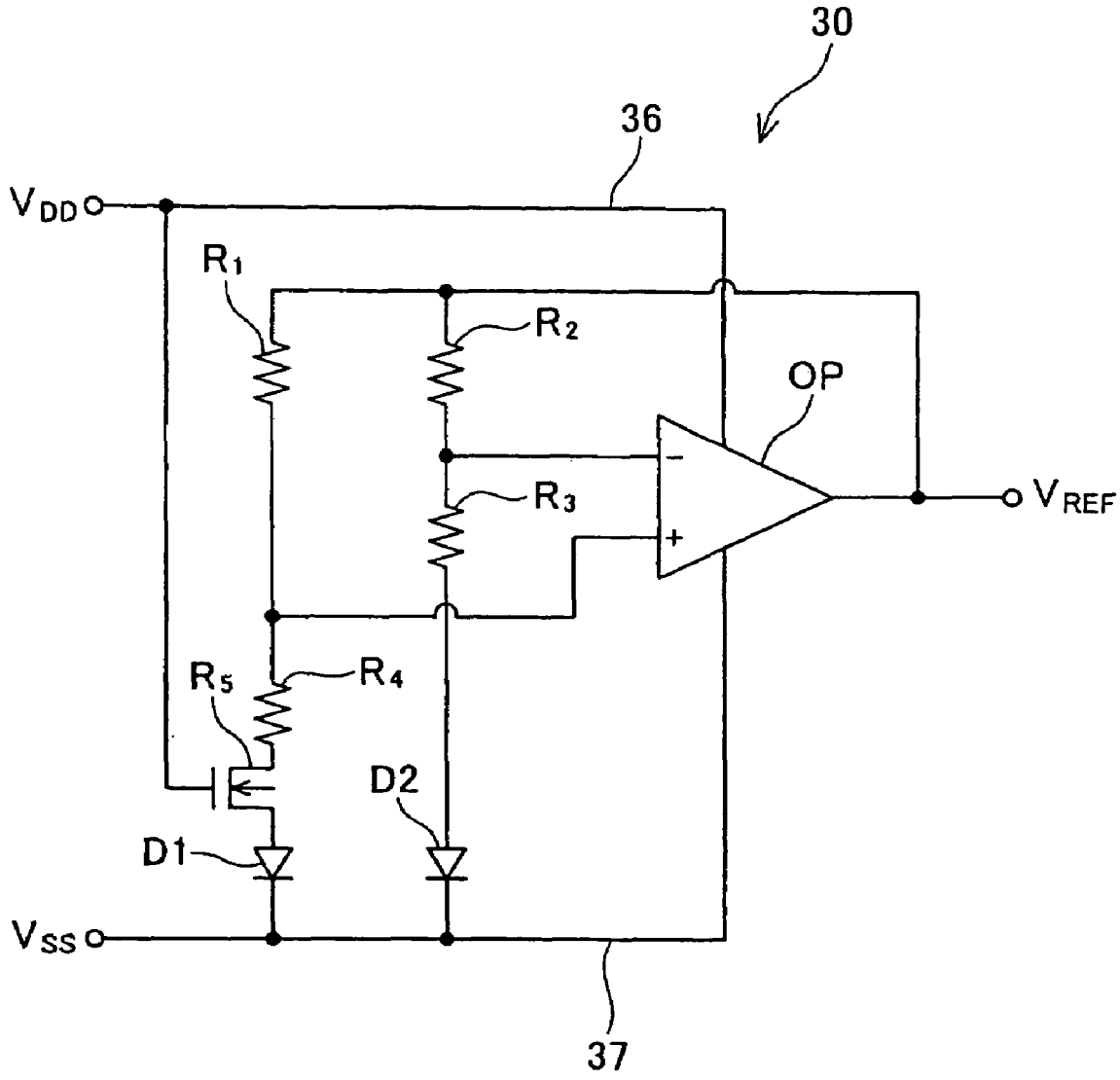
FIG. 5 shows a reference voltage circuit of a modification.

For example, a reference voltage circuit 30 achieved by combining the technique of the first embodiment and the technique of the second embodiment may be constructed as shown in FIG. 5. The reference voltage circuit 30 shown in FIG. 3 is equipped with an in-series circuit of a fourth fixed resistor $R_4$ and a transistor $R_5$. One end of the fourth fixed resistor $R_4$ is connected to the non-inverting input terminal of the operational amplifier OP, and the other end thereof is connected to the drain terminal of the transistor $R_5$. The source terminal of the transistor $R_5$ is connected to the anode terminal of the first diode D1. This reference voltage circuit 30 can have both of the characteristic of compensating for the temperature variation with high precision and the characteristic of compensating for the variation of the power source voltage. The reference voltage circuit 30 can output a remarkably stable reference voltage.

In this modification, it is preferable to set the temperature characteristic of each resistor in the following order. First, the resistance value $R_{50}$ of the transistor $R_5$ and the power source voltage coefficient c are selected on the basis of the equation (15) so that the coefficient of the term of $\Delta V_{DD}$ is reduced. Specifically, these parameters are selected so that the resistance value $R_{50}$ of the transistor $R_5$ is sufficiently smaller than the resistance value $R_1$ of the first fixed resistor $R_1$, and also the power source voltage coefficient c is negative. Subsequently, the resistance characteristic of the fourth fixed resistor $R_4$ is determined. At this time, the fourth fixed resistor $R_4$ is selected so as to satisfy such a condition that the resistance value thereof is smaller than that of the first fixed resistor $R_1$ and the resistance temperature coefficient thereof is smaller than those of the other fixed resistors $R_1$, $R_2$, $R_3$. Subsequently, in conformity with the resistance characteristic of the fourth fixed resistor $R_4$ thus selected, the resistance values of the other fixed resistors $R_2$, $R_3$ are selected on the basis of the equation (12) so that the coefficient of the primary term of $\Delta T$ is equal to zero. Accordingly, the effect of the higher order terms of $\Delta T$ of the equation (12) is reduced, and further the effect of the primary term is also offset. By selecting the characteristic of each resistor as described above, the reference voltage can be achieved with compensating for the variation of the power source voltage and also compensating for the variation of the background temperature with high temperature.

The technical elements of this specification and the drawings exercise the technical utility alone or by each of various combinations thereof, however, the present invention is not limited to these combinations described in the specification and the claims. Furthermore, the technique disclosed in this specification and the drawings can achieve plural objects at the same time, and it has the technical utility by achieving one of the objects.

What is claimed is:

1. A reference voltage circuit for outputting a stable reference voltage comprising:

a first semiconductor inserted in a forward direction with respect to a negative power supply line of a power source voltage and a second semiconductor inserted in the forward direction with respect to the negative power supply line, wherein each of the first and second semiconductors comprises a PN junction;

an operational amplifier connected to a positive power supply line and the negative power supply line of the power source voltage, wherein one end of a first resistor is connected to an output terminal of the operational amplifier and an other end of the first resistor is connected to a non-inverting input terminal of the operational amplifier, one end of a second resistor is connected to the output terminal of the operational amplifier and an other end of the second resistor is connected to an inverting input terminal of the operational amplifier, one end of a third resistor is connected to the inverting input terminal of the operational amplifier and an other end of the third resistor is connected to the second semiconductor; and a fourth resistor having one end connected to the non-inverting input terminal of the operational amplifier and an other end connected to the first semiconductor, wherein a resistance value of the fourth resistor is set to be smaller than a resistance value of the first resistor.

2. The reference voltage circuit according to claim 1, wherein a resistance temperature coefficient of the fourth resistor is set to be larger than a resistance temperature coefficient of each of the first, second and third resistors, thereby outputting a stable reference voltage against variation of background temperature.

3. The reference voltage circuit according to claim 1, wherein the fourth resistor is a variable resistor whose resistance value varies while following variation of a power source voltage, thereby outputting a stable reference voltage against variation of the power source voltage.

4. The reference voltage circuit according to claim 3, wherein the resistance value of the fourth resistor is reduced while following increase of the power source voltage.

5. The reference voltage circuit according to claim 4, wherein the fourth resistor is an n-type MOSFET having a drain terminal connected to the non-inverting input terminal of the operational amplifier, a source terminal connected to the first semiconductor, and a gate terminal connected to the positive power supply line.

6. A reference voltage circuit for outputting a stable reference voltage comprising:

a first semiconductor inserted in the forward direction with respect to a negative power supply line of a power source voltage and a second semiconductor inserted in the forward direction with respect to the negative power supply line, wherein each of the first and second semiconductors comprises a PN junction;

an operational amplifier connected to a positive power supply line and the negative power supply line of the power source voltage, wherein one end of a first resistor is connected to an output terminal of the operational amplifier and an other end of the first resistor is connected to a non-inverting input terminal of the operational amplifier, one end of a second resistor is connected to the output terminal of the operational amplifier and an other end of the second resistor is connected to an inverting input terminal of the operational amplifier, one end of a third resistor is connected to the inverting input terminal of the operational amplifier and an other end of the third resistor is connected to the second semiconductor; and a fourth resistor comprising a fixed resistor and a variable resistor connected to each other in series, a resistance temperature coefficient of the fixed resistor being set to be larger than a resistance temperature coefficient of each of the first, second and third resistors, and a resistance value of the variable resistor varies in accordance with variation of the power source voltage.

* * * * *